US007364098B2

(12) United States Patent
Alexander et al.

(10) Patent No.: US 7,364,098 B2
(45) Date of Patent: Apr. 29, 2008

(54) MATERIAL DISPENSING APPARATUS

(75) Inventors: Kevin L. Alexander, Brownsburg, IN (US); Michael C. Rodgers, Montpelier, OH (US)

(73) Assignee: Illinois Tool Works Inc., Glenview, IL (US)

( * ) Notice: Subject to any disclaimer, the term of this patent is extended or adjusted under 35 U.S.C. 154(b) by 169 days.

(21) Appl. No.: 11/248,581

(22) Filed: Oct. 12, 2005

(65) Prior Publication Data

US 2007/0080243 A1 Apr. 12, 2007

(51) Int. Cl.
*B05B 15/06* (2006.01)
*B05B 1/00* (2006.01)

(52) U.S. Cl. ..... 239/531; 239/600; 239/375; 239/525

(58) Field of Classification Search ..... 239/525–531, 239/600, 601, 375–379; 222/146, 482, 210, 222/215

See application file for complete search history.

(56) References Cited

U.S. PATENT DOCUMENTS

| | | | | | |
|---|---|---|---|---|---|
| 1,996,156 | A | * | 4/1935 | Janssen | 222/490 |
| 2,634,692 | A | * | 4/1953 | Sherbondy | 425/172 |
| 2,815,895 | A | * | 12/1957 | Reed | 222/568 |
| 2,928,533 | A | * | 3/1960 | Loucony | 206/375 |
| 3,265,306 | A | | 8/1966 | Fischer et al. | |
| 3,818,930 | A | * | 6/1974 | Crum et al. | 137/341 |
| 3,940,061 | A | | 2/1976 | Gimple et al. | |
| 3,964,683 | A | | 6/1976 | Gimple | |
| 3,990,609 | A | | 11/1976 | Grant | |
| 4,001,935 | A | | 1/1977 | Krohn et al. | |
| 4,002,777 | A | | 1/1977 | Juvinall et al. | |
| 4,030,857 | A | | 6/1977 | Smith, Jr. | |
| 4,037,561 | A | | 7/1977 | LaFave et al. | |
| 4,075,677 | A | | 2/1978 | Bentley | |
| 4,081,904 | A | | 4/1978 | Krohn et al. | |
| 4,105,164 | A | | 8/1978 | Lau et al. | |
| 4,114,564 | A | | 9/1978 | Probst | |
| 4,116,364 | A | | 9/1978 | Culbertson et al. | |
| 4,133,483 | A | | 1/1979 | Henderson | |
| D252,097 | S | | 6/1979 | Probst et al. | |
| 4,165,022 | A | | 8/1979 | Bentley et al. | |
| 4,169,545 | A | | 10/1979 | Decker | |
| 4,174,070 | A | | 11/1979 | Lau et al. | |
| 4,174,071 | A | | 11/1979 | Lau et al. | |
| 4,214,709 | A | | 7/1980 | Scull et al. | |
| 4,248,386 | A | | 2/1981 | Morle | |

(Continued)

FOREIGN PATENT DOCUMENTS

EP 1 393 81 A 3/2001

OTHER PUBLICATIONS

International Search Report from PCT/US2006/034704.

*Primary Examiner*—Kevin Shaver
*Assistant Examiner*—James S Hogan
(74) *Attorney, Agent, or Firm*—Barnes & Thornburg LLP

(57) ABSTRACT

A device for dispensing coating material includes a handle and a barrel coupled to the handle and extending therefrom toward a forward end from which coating material is dispensed. A first component is provided on the dispensing device. Multiple second components each include a portion which is complementary to the first component. At least one of the multiple second components comprises a tool for use in conjunction with the operation of the dispensing device.

14 Claims, 6 Drawing Sheets

U.S. PATENT DOCUMENTS 4,331,298 A 5/1982 Bentley et al.
RE30,968 E 6/1982 Grant
4,361,283 A 11/1982 Hetherington et al.
D270,179 S 8/1983 Grime
D270,180 S 8/1983 Grime
D270,367 S 8/1983 Grime
D270,368 S 8/1983 Grime
4,401,268 A 8/1983 Pomponi, Jr.
4,433,812 A 2/1984 Grime
4,437,614 A 3/1984 Garcowski
4,453,670 A 6/1984 Sirovy
4,483,483 A 11/1984 Grime
4,513,913 A 4/1985 Smith
4,529,131 A 7/1985 Rutz
4,537,357 A 8/1985 Culbertson et al.
4,606,501 A 8/1986 Bate et al.
4,613,082 A 9/1986 Gimple et al.
D287,266 S 12/1986 Knetl et al.
4,702,420 A 10/1987 Rath
4,747,546 A 5/1988 Talacko
4,759,502 A 7/1988 Pomponi, Jr. et al.
4,760,962 A 8/1988 Wheeler
4,770,117 A 9/1988 Hetherington et al.
4,844,342 A 7/1989 Foley
D303,139 S 8/1989 Morgan
D305,057 S 12/1989 Morgan
D305,452 S 1/1990 Morgan
D305,453 S 1/1990 Morgan
4,911,367 A 3/1990 Lasley
4,927,079 A 5/1990 Smith
4,934,603 A 6/1990 Lasley
4,934,607 A 6/1990 Lasley
4,993,645 A 2/1991 Buschor
5,022,590 A * 6/1991 Buschor ..... 239/708
D318,712 S 7/1991 Buschor
5,054,687 A 10/1991 Burns et al.
5,064,119 A 11/1991 Mellette
5,074,466 A 12/1991 Santiago
5,090,623 A 2/1992 Burns et al.
D325,241 S 4/1992 Buschor
5,118,080 A 6/1992 Hartmann
5,119,992 A 6/1992 Grime
5,159,544 A 10/1992 Hughey et al.
5,178,330 A 1/1993 Rodgers
5,180,104 A 1/1993 Mellette
5,209,365 A 5/1993 Wood
5,209,405 A 5/1993 Robinson et al.
5,236,129 A 8/1993 Grime et al.
5,284,299 A 2/1994 Medlock
5,284,301 A 2/1994 Kieffer
5,289,974 A 3/1994 Grime et al.
5,299,740 A 4/1994 Bert
5,303,865 A 4/1994 Bert
5,330,108 A 7/1994 Grime et al.
5,332,156 A 7/1994 Wheeler
5,332,159 A 7/1994 Grime et al.
D349,559 S 8/1994 Vanderhoef et al.
5,351,887 A 10/1994 Heterington et al.
5,395,054 A 3/1995 Wheeler
5,400,971 A 3/1995 Maugans et al.
5,553,788 A 9/1996 Del Gaone et al.
5,582,350 A 12/1996 Kosmyna et al.
5,618,001 A 4/1997 Del Gaone et al.
5,639,027 A 6/1997 Fritz
RE35,769 E 4/1998 Grime et al.
5,803,313 A 9/1998 Flatt et al.
5,829,679 A 11/1998 Strong
5,836,517 A 11/1998 Burns et al.
RE36,378 E 11/1999 Mellette
5,978,244 A 11/1999 Hughey
6,026,985 A * 2/2000 Elliott, Sr. ..... 222/1
6,144,570 A 11/2000 Hughey
6,161,256 A 12/2000 Quiring et al.
6,179,223 B1 1/2001 Sherman et al.
6,189,809 B1 2/2001 Schwebemeyer
6,276,616 B1 8/2001 Jenkins
6,402,058 B2 6/2002 Kaneko et al.
6,423,142 B1 7/2002 Hughey
6,460,787 B1 10/2002 Hartle et al.
6,572,029 B1 6/2003 Holt
6,572,034 B1 * 6/2003 Liu ..... 239/531
6,669,112 B2 12/2003 Reetz, III et al.
6,688,500 B1 * 2/2004 Cheng ..... 222/482
6,698,670 B1 3/2004 Gosis et al.
6,712,292 B1 3/2004 Gosis et al.
6,752,238 B2 * 6/2004 Small et al. ..... 181/149
6,811,099 B2 * 11/2004 Krestine et al. ..... 239/524

* cited by examiner

MATERIAL DISPENSING APPARATUS

FIELD OF THE INVENTION

This invention relates to the configurations of hand-held tools. It is disclosed in the context of a configuration for coating dispensing equipment (hereinafter sometimes spray guns). However, it is believed to be useful in other applications as well.

BACKGROUND OF THE INVENTION

A great number of configurations for hand-held tools are known. Among configurations of interest are the configurations illustrated and described in the following listed U.S. Patents and published applications: 2003/0006322; 6,712,292; 6,698,670; 6,669,112; 6,572,029; 6,460,787; 6,402,058; RE36,378; 6,276,616; 6,189,809; 6,179,223; 5,836,517; 5,829,679; 5,803,313; RE35,769; 5,639,027; 5,618,001; 5,582,350; 5,553,788; 5,400,971; 5,395,054; D349,559; 5,351,887; 5,332,159; 5,332,156; 5,330,108; 5,303,865; 5,299,740; 5,289,974; 5,284,301; 5,284,299; 5,236,129; 5,209,405; 5,209,365; 5,178,330; 5,119,992; 5,118,080; 5,180,104; D325,241; 5,090,623; 5,074,466; 5,064,119; 5,054,687; D318,712; 5,022,590; 4,993,645; 4,934,607; 4,934,603; 4,927,079; 4,911,367; D305,453; D305,452; D305,057; D303,139; 4,844,342; 4,770,117; 4,760,962; 4,759,502; 4,747,546; 4,702,420; 4,613,082; 4,606,501; D287,266; 4,537,357; 4,529,131; 4,513,913; 4,483,483; 4,453,670; 4,437,614; 4,433,812; 4,401,268; 4,361,283; D270,368; D270,367; D270,180; D270,179; RE30,968; 4,331,298; 4,248,386; 4,214,709; 4,174,071; 4,174,070; 4,169,545; 4,165,022; D252,097; 4,133,483; 4,116,364; 4,114,564; 4,105,164; 4,081,904; 4,037,561; 4,030,857; 4,002,777; 4,001,935; 3,990,609; 3,964,683; 3,940,061; and, 3,265,306. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a device for dispensing coating material includes a handle and a barrel coupled to the handle and extending therefrom toward a forward end from which coating material is dispensed, a port including an opening provided with a first closure device, and multiple closures. Each of the multiple closures is provided with a second closure device complementary to the first closure device to close the port.

Illustratively according to this aspect of the invention, one of the first and second closure devices comprises opposite edges provided with grooves, and the other of the first and second closure devices comprises opposite edges provided with complementary tongues for sliding engagement with grooves to close the port.

Further illustratively according to this aspect of the invention, the first closure device comprises opposite edges provided with grooves, and each of the multiple closures comprises opposite edges provided with complementary tongues for sliding engagement in the grooves to close the port.

Illustratively according to this aspect of the invention, at least one of the closures includes a tool.

Illustratively according to this aspect of the invention, at least one of the closures comprises an attachment device for attaching the dispensing device to a support.

Illustratively according to this aspect of the invention, the port comprises an access port providing access to components within the dispensing device when a respective closure is removed therefrom.

Illustratively according to this aspect of the invention, the access port is defined at a junction of the handle and barrel.

According to another aspect of the invention, a device for dispensing coating material includes a handle and a barrel coupled to the handle and extending therefrom toward a forward end from which coating material is dispensed. A first component is provided on the dispensing device. Each of multiple second components includes a portion which is complementary to the first component. At least one of the multiple second components comprises a tool for use in conjunction with the operation of the dispensing device.

Illustratively according to this aspect of the invention, one of the first and second components comprises opposite edges provided with grooves, and the other of the first and second components comprises opposite edges provided with complementary tongues for sliding engagement with the grooves.

Illustratively according to this aspect of the invention, the first component comprises opposite edges provided with grooves, and each of the multiple second components comprises opposite edges provided with complementary tongues for sliding engagement in the grooves.

Illustratively according to this aspect of the invention, the at least one of the multiple second components comprises a hook for hooking the dispensing device onto a support.

BRIEF DESCRIPTION OF THE DRAWINGS

The invention may best be understood by referring to the following description and accompanying drawings which illustrate the invention. In the drawings.

DETAILED DESCRIPTIONS OF ILLUSTRATIVE EMBODIMENTS

Figure 1:
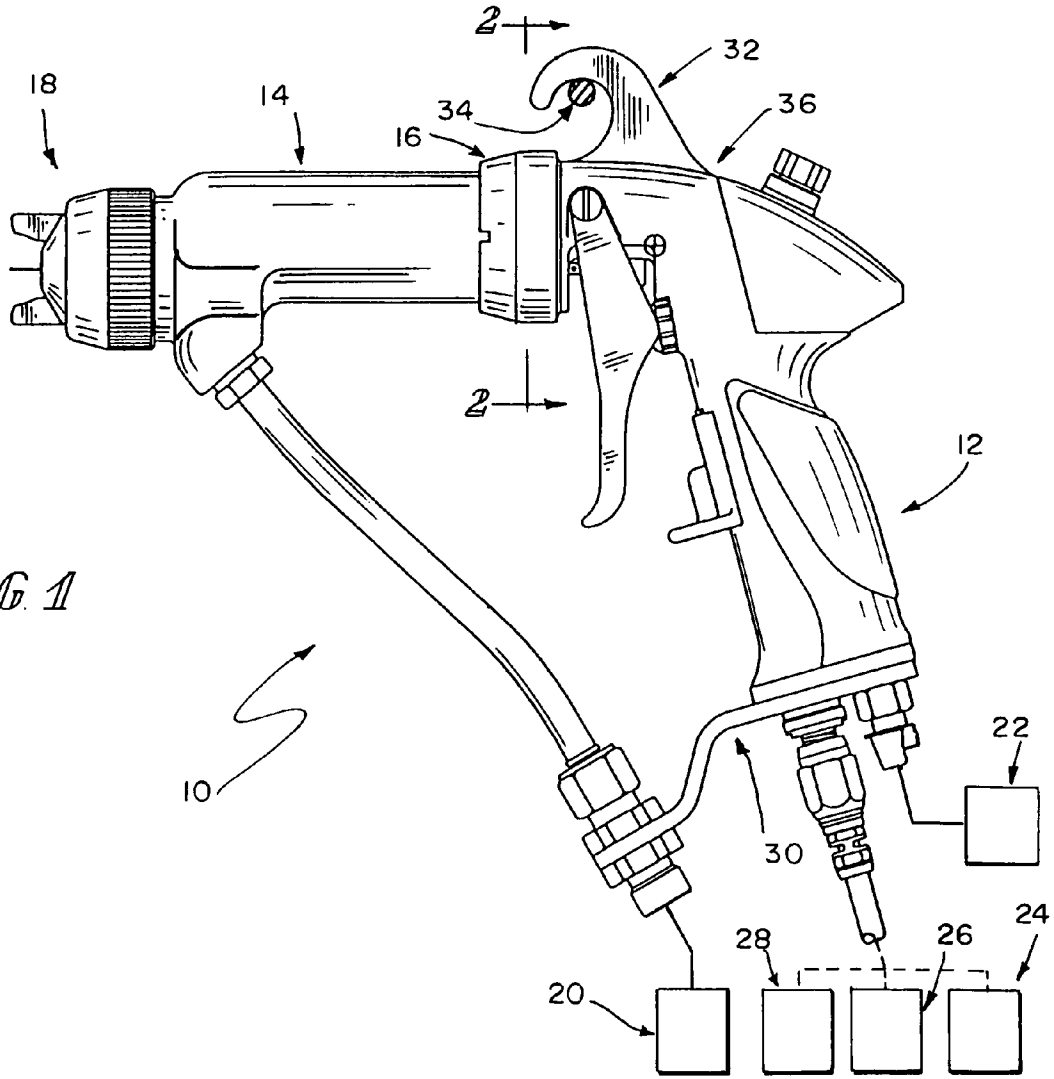
FIG. 1 illustrates a partly block diagrammatic side elevational view of a spray gun incorporating the present invention.
Figure 2:
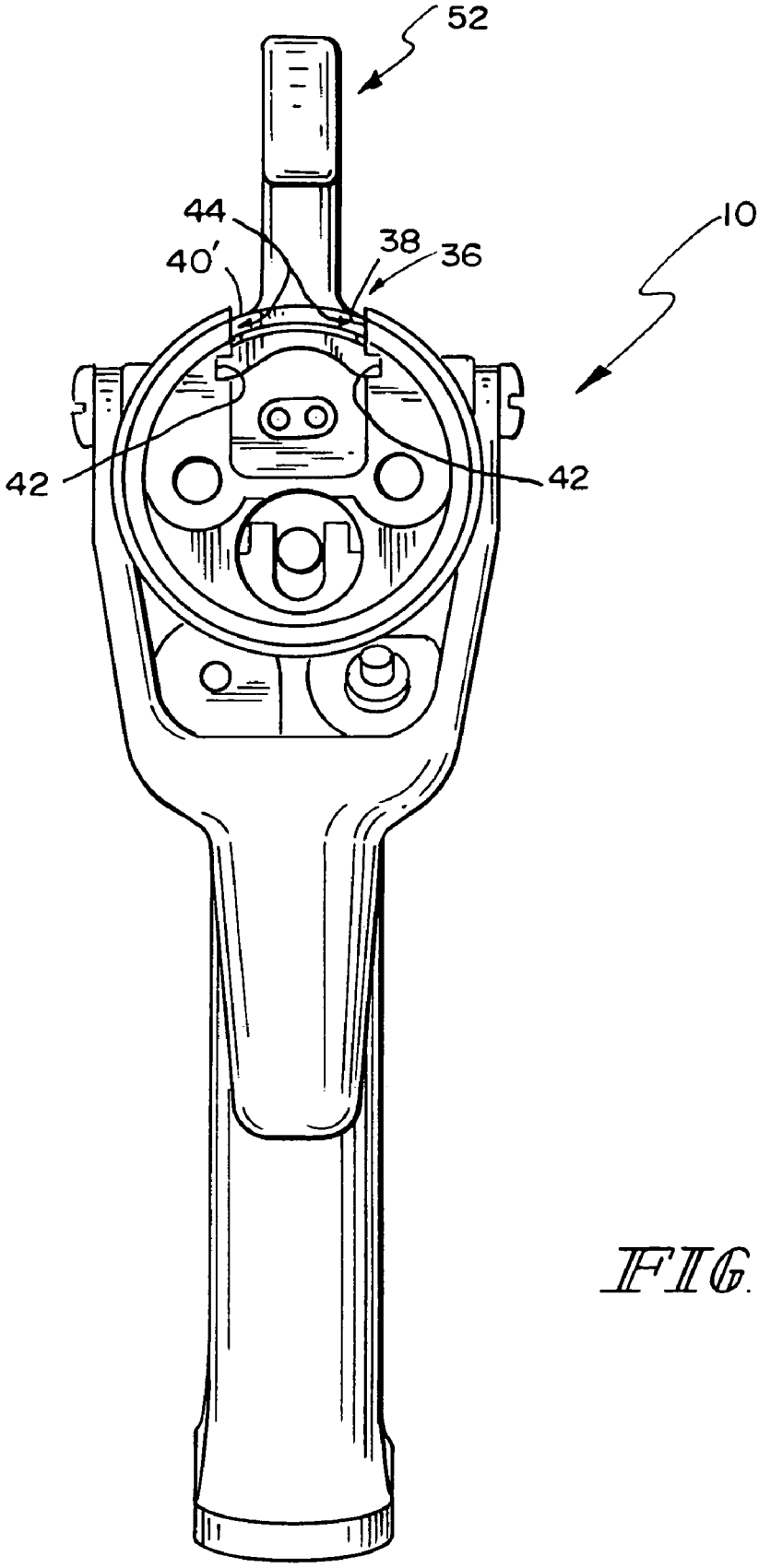
FIG. 2 illustrates a fragmentary end elevational view of the spray gun illustrated in FIG. 1, taken generally along section lines 2-2 thereof.
Figure 3:
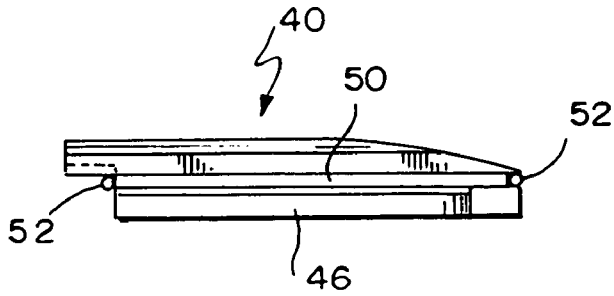
FIG. 3 illustrates a side elevational view of a component constructed according to the present invention.
Figure 4:
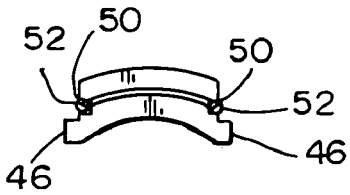
FIG. 4 illustrates an end elevational view of the component illustrated in FIG. 3.
Figure 5:
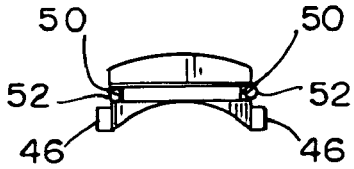
FIG. 5 illustrates an end elevational view of the component illustrated in FIGS. 3-4 taken from the end opposite the end illustrated in FIG. 3.
Figure 5A:
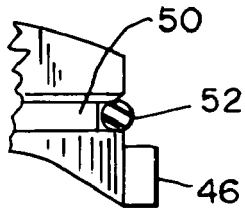
FIG. 5*a* illustrates an enlarged detail of FIG. 5.
Figure 6:
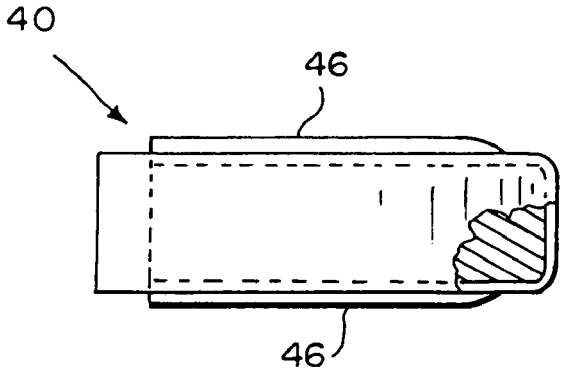
FIG. 6 illustrates a partly sectional top plan view of the component illustrated in FIGS. 3-5*a;*
Figure 7:
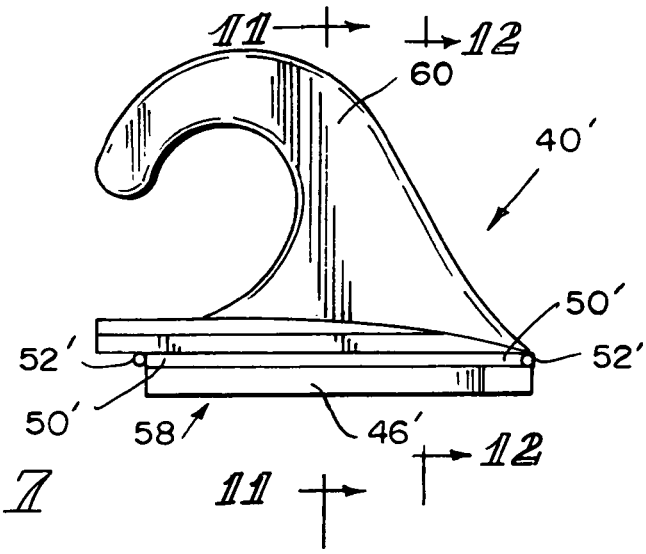
FIG. 7 illustrates a side elevational view of a component constructed according to the present invention.
Figure 8:
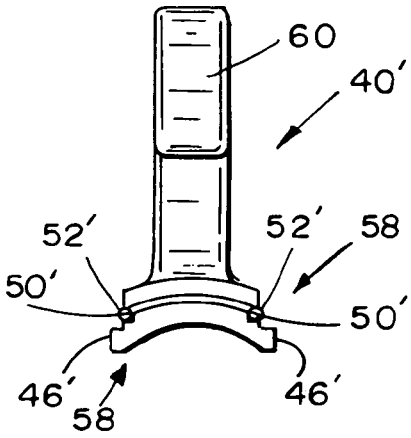
FIG. 8 illustrates an end elevational view of the component illustrated in FIG. 7.
Figure 9:
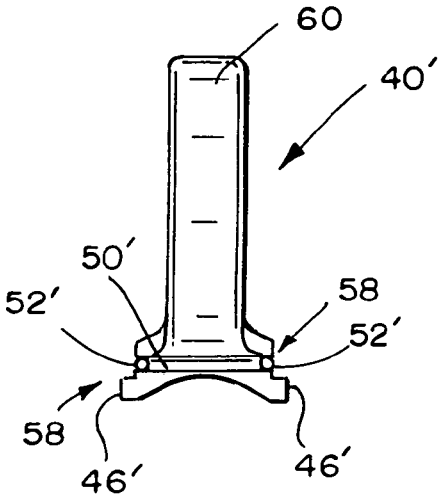
FIG. 9 illustrates an end elevational view of the component illustrated in FIGS. 7-8 taken from the end opposite the end illustrated in FIG. 8.
Figure 10:
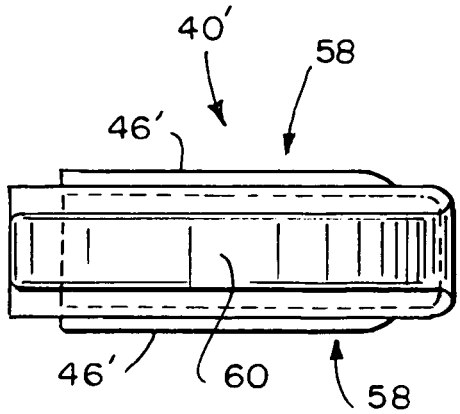
FIG. 10 illustrates a top plan view of the component illustrated in FIGS. 7-9.
Figure 11:
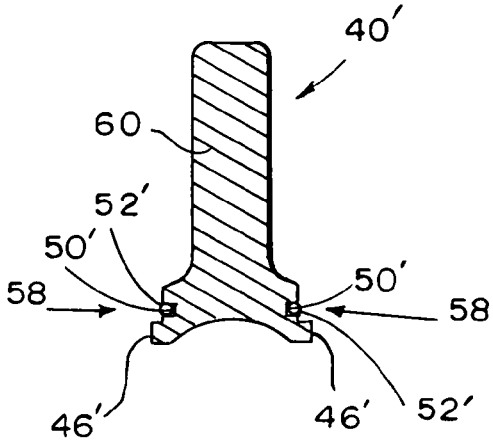
FIG. 11 illustrates a fragmentary sectional view of the component illustrated in FIGS. 7-10, taken generally along section lines 11-11 of FIG. 7.
Figure 12:
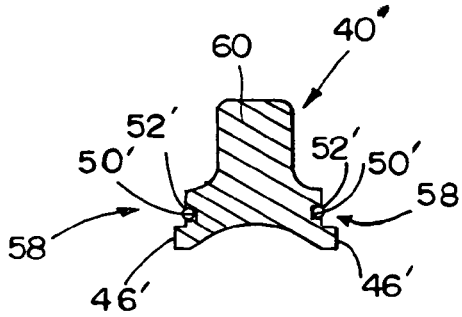
FIG. 12 illustrates a fragmentary sectional view of the component illustrated in FIGS. 7-11, taken generally along section lines 12-12 of FIG. 7.
Figure 13:
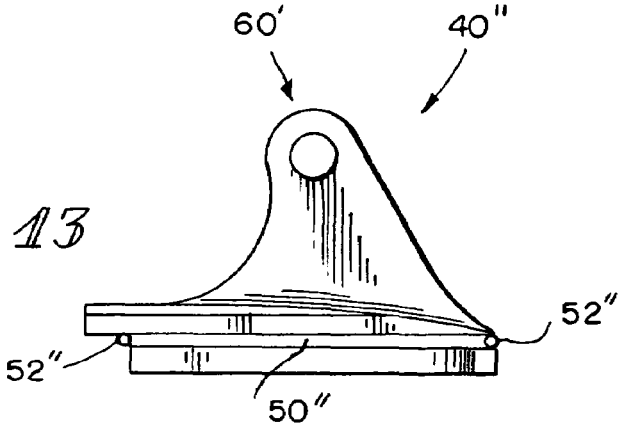
FIG. 13 illustrates a side elevational view of a component constructed according to the present invention.
Figure 14:
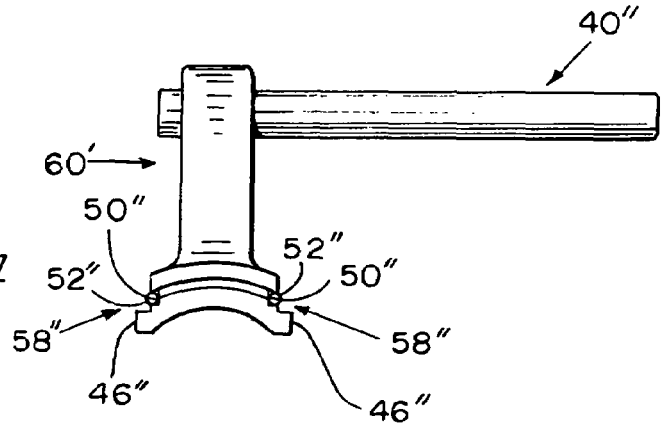
FIG. 14 illustrates an end elevational view of the component illustrated in FIG. 13.
Figure 15:
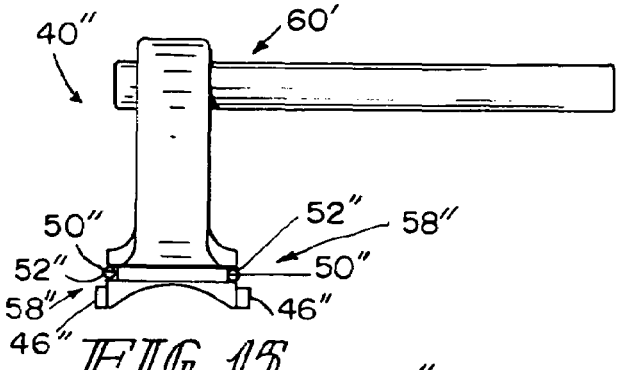
FIG. 15 illustrates an end elevational view of the component illustrated in FIGS. 13-14 taken from the end opposite the end illustrated in FIG. 14.
Figure 15A:
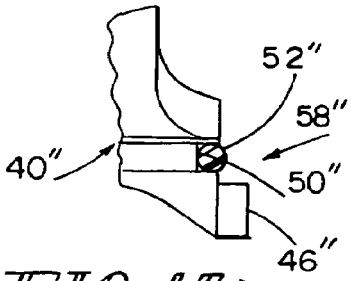
FIG. 15*a* illustrates an enlarged detail of FIG. 15.
Figure 16:
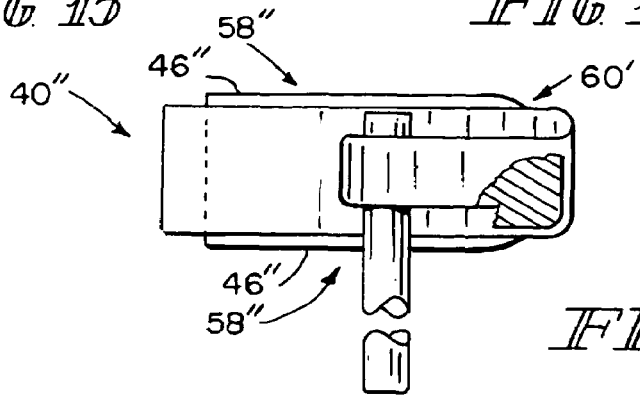
FIG. 16 illustrates a top plan view of the component illustrated in FIGS. 13-15*a*.

Referring first to FIGS. 1-2, a spray gun 10 includes a handle 12 and a barrel 14 coupled at its rearward end 16 to the handle and extending forward therefrom toward a forward end 18 which is provided with a nozzle through which material is dispensed for coating an article presented in front of the spray gun 10. The spray gun may be any of a number of known types, air, airless, air-assisted airless, high-volume, low pressure (HVLP), and so on. Appropriate services for the particular type of spray gun 12 being used, such as coating material 20, compressed air 22, and a selected one of a high-magnitude DC electrostatic potential source 24, a low-magnitude DC (26) or AC (28) electrical potential source (for spray guns 12 having internal high-magnitude DC electrostatic potential generators), and so on, are typically provided. The services 20, 22, 24, 26, 28 typically are coupled through appropriate connectors at the lower end 30 of the handle 12 or on the underside of the barrel 14 between the rearward end 16 and forward end 18 thereof.

In the past, such guns 12 have typically been provided with hooks 32 by which the spray guns 12 could be hung, for example, on a spray booth support 34 when not in use. In some cases, the hooks 32 have been removable, for example, to permit the gun 12 to be introduced into a tight space for painting, and different configuration hooks have been available for different applications, or to suit the needs and/or preferences of different users. In the present spray gun 12, an access port 36 is provided at the rear of the handle 12/barrel 14 junction for access to certain internal components of the spray gun 12. For example, if the spray gun 12 is provided with high-magnitude electrostatic potential from a source 24, it is quite common for the barrel to include a high value resistor to damp electrical discharges through the coating material charging electrode(s) (not shown) with which such a spray gun 12 is equipped. Access to such a resistor might be provided through access port 36.

Another example of equipment within the spray gun 12 which might advantageously be accessed through such an access port 36 involves spray guns 12 equipped with inverters, step-up transformers and rectifier/multipliers for inverting a low-magnitude DC voltage provided from a source 26 to a low-magnitude AC voltage, stepping the AC voltage up to a higher magnitude using a voltage step-up transformer, and multiplying the stepped up voltage using, for example, a Cockcroft-Walton multiplier of the general type illustrated and described in, for example, U.S. Pat. Nos.: 5,159,544; 5,978,244; 6,144,570; and, 6,423,142. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred. The port 36 might permit access to one or more of such an inverter, step-up transformer and multiplier.

In any event, and with reference to FIGS. 2-6, the access port includes an opening 38 and a closure 40 for closing the opening. One of the opening 38 and closure 40, here the opening 38, is provided with grooves 42 along opposite edges 44 of opening 38. The other of the opening 38 and closure 40, here the closure 40, is provided with complementary tongues 46 along opposite edges 48 thereof. The tongues 46 are slidably received in the grooves 42 and the closure 40 is slid into place closing port 36. Illustratively, the closure 40 is held in place by attachment of the barrel 14 to the handle 12. Alternatively, the closure 40 may be a tight sliding fit into the opening 38. Further alternatively, an appropriate fastening arrangement, such as a detent and a notch provided in the closure 40 and a surface of the handle 12 or barrel 14, a threaded fastener and complementary hole, or the like, may be provided to retain the closure 40 in a closed orientation in the opening 38. A groove 50 is provided at least partway around the perimeter of closure 40 to accommodate a sealing O-ring 52 (shown in section) which seals the interior of spray gun 12 against the entry of airborne contaminants, such as coating material particles common in areas where spray coating is being conducted.

Referring now to FIGS. 2 and 7-12, the closure 40 can be replaced by a closure 40' including a hook 60 of any desired configuration. Like the closure 40, the closure 40' includes tongues 46' along opposite edges 58 thereof. The tongues 46' are slidably received in the grooves 42 and the closure 40' is slid into place, closing port 36. Again, the closure 40' may be held in place by attachment of the barrel 14 to the handle 12, or may be a tight sliding fit into the opening 38, or an appropriate fastening arrangement may be provided to retain closure 40' in a closed orientation in the opening 38. Again, a groove 50' is provided at least partway around the perimeter of closure 40' to accommodate a sealing O-ring 52' (shown in section) which seals the interior of spray gun 12 against the entry of airborne contaminants, such as coating material particles common in areas where spray coating is being conducted.

Referring now to FIGS. 2 and 13-16, the closure 40 can be replaced by a closure 40" including another tool 60' of any desired configuration. In this instance, tool 60' includes a door opener rod. Like the closures 40, 40', the closure 40" includes tongues 46" along opposite edges 58" thereof. The tongues 46" are slidably received in the grooves 42 and the closure 40" is slid into place, closing port 36. Again, the closure 40" may be held in place by attachment of the barrel 14 to the handle 12, or may be a tight sliding fit into the opening 38, or an appropriate fastening arrangement may be provided to retain closure 40" in a closed orientation in the opening 38. Again, a groove 50" is provided at least partway around the perimeter of closure 40" to accommodate a sealing O-ring 52" (shown in section) which seals the interior of spray gun 12 against the entry of airborne contaminants, such as coating material particles common in areas where spray coating is being conducted.

The closures 40, 40', 40" can be constructed from any suitable materials. In typical embodiments, one or both of handle 12 and barrel 14 can be molded from any suitable filled or unfilled resin or polymer, for example, gray carbon fiber nylon 12, and closures 40, 40', 40" can be molded from the same or similar materials, with suitable regard for the durability requirements of the spray gun 10 and hooks 60 or other tools 60'.

What is claimed is:

1. A device for dispensing coating material, the dispensing device including a handle and a barrel coupled to the handle and extending therefrom toward a forward end from which coating material is dispensed, the dispensing device further including adjacent the point at which the barrel extends forward from the handle a port including an opening provided with a first closure device, and multiple closures, each of the multiple closures provided with a second closure device complementary to the first closure device to close the port, at least one of the closures including a tool.

2. A device for dispensing coating material, the dispensing device including a handle and a barrel coupled to the handle and extending therefrom toward a forward end from which coating material is dispensed, the dispensing device further including adjacent the point at which the barrel extends forward from the handle a port including an opening provided with a first closure device, and multiple closures, each of the multiple closures provided with a second closure device complementary to the first closure device to close the port, at least one of the closures comprising an attachment device for attaching the dispensing device to a support.

3. A device for dispensing coating material, the dispensing device including a handle and a barrel coupled to the handle and extending therefrom toward a forward end from which coating material is dispensed, the dispensing device further including adjacent the point at which the barrel extends forward from the handle a port including an opening provided with a first closure device, and multiple closures, each of the multiple closures provided with a second closure device complementary to the first closure device to close the port, one of the first and second closure devices comprising opposite edges provided with grooves, and the other of the first and second closure devices comprising opposite edges provided with complementary tongues for sliding engagement with grooves to close the port.

4. A device for dispensing coating material, the dispensing device including a handle and a barrel coupled to the handle and extending therefrom toward a forward end from which coating material is dispensed, a port including an opening provided with a first closure device, and multiple closures, each of the multiple closures provided with a second closure device complementary to the first closure device to close the port, one of the first and second closure devices comprises opposite edges provided with grooves, and the other of the first and second closure devices comprises opposite edges provided with complementary tongues for sliding engagement with grooves to close the port, at least one of the closures including a tool.

5. A device for dispensing coating material, the dispensing device including a handle and a barrel coupled to the handle and extending therefrom toward a forward end from which coating material is dispensed, a port including an opening provided with a first closure device, and multiple closures, each of the multiple closures provided with a second closure device complementary to the first closure device to close the port, one of the first and second closure devices comprises opposite edges provided with grooves, and the other of the first and second closure devices comprises opposite edges provided with complementary tongues for sliding engagement with grooves to close the port, at least one of the closures comprising an attachment device for attaching the dispensing device to a support.

6. A device for dispensing coating material, the dispensing device including a handle and a barrel coupled to the handle and extending therefrom toward a forward end from which coating material is dispensed, a port including an opening provided with a first closure device, and multiple closures, each of the multiple closures provided with a second closure device complementary to the first closure device to close the port, one of the first and second closure devices comprises opposite edges provided with grooves, and the other of the first and second closure devices comprises opposite edges provided with complementary tongues for sliding engagement with grooves to close the port, the port comprising an access port providing access to components within the dispensing device when a respective closure is removed therefrom.

7. The dispensing device of claim 6 wherein the access port is defined at a junction of the handle and barrel.

8. A device for dispensing coating material, the dispensing device including a handle and a barrel coupled to the handle and extending therefrom toward a forward end from which coating material is dispensed, a port including an opening provided with a first closure device, and multiple closures, each of the multiple closures provided with a second closure device complementary to the first closure device to close the port, one of the first and second closure devices comprises opposite edges provided with grooves, and the other of the first and second closure devices comprises opposite edges provided with complementary tongues for sliding engagement with grooves to close the port, the first closure device comprising opposite edges provided with grooves, and each of the multiple closures comprising opposite edges provided with complementary tongues for sliding engagement in the grooves to close the port.

9. The dispensing device of claim 8 wherein at least one of the closures comprises an attachment device for attaching the dispensing device to a support.

10. A device for dispensing coating material, the dispensing device including a handle and a barrel coupled to the handle and extending therefrom toward a forward end from which coating material is dispensed, a first component provided on the dispensing device adjacent the point at which the barrel extends forward from the handle, and multiple second components, each of the multiple second components including a portion which is complementary to the first component, at least one of the multiple second components comprising a tool for use in conjunction with the operation of the dispensing device, the at least one of the multiple second components comprising a hook for hooking the dispensing device onto a support.

11. A device for dispensing coating material, the dispensing device including a handle and a barrel coupled to the handle and extending therefrom toward a forward end from which coating material is dispensed, a first component provided on the dispensing device, and multiple second components, each of the multiple second components including a portion which is complementary to the first component, at least one of the multiple second components comprising a tool for use in conjunction with the operation of the dispensing device, one of the first and second components comprising opposite edges provided with grooves, and the other of the first and second components comprising opposite edges provided with complementary tongues for sliding engagement with the grooves.

12. The dispensing device of claim 11 wherein the at least one of the multiple second components comprises a hook for hooking the dispensing device onto a support.

13. The dispensing device of claim 11 wherein the first component comprises opposite edges provided with grooves, and each of the multiple second components comprises opposite edges provided with complementary tongues for sliding engagement in the grooves.

14. The dispensing device of claim 13 wherein the at least one of the multiple second components comprises a hook for hooking the dispensing device onto a support.

* * * * *